US007555147B2

(12) United States Patent
Simmons

(10) Patent No.: US 7,555,147 B2
(45) Date of Patent: Jun. 30, 2009

(54) VIDEO RECORDING SYSTEM FOR AN AMUSEMENT PARK RIDE AND ASSOCIATED METHODS

(76) Inventor: Richard Simmons, 6206 Dartmoor Ct., Orlando, FL (US) 32819

( * ) Notice: Subject to any disclaimer, the term of this patent is extended or adjusted under 35 U.S.C. 154(b) by 19 days.

(21) Appl. No.: 11/343,399

(22) Filed: Jan. 31, 2006

(65) Prior Publication Data

US 2007/0078013 A1 Apr. 5, 2007

Related U.S. Application Data

(60) Provisional application No. 60/722,908, filed on Sep. 30, 2005.

(51) Int. Cl.
*G06K 9/00* (2006.01)

(52) U.S. Cl. ..... 382/115; 382/103; 472/60

(58) Field of Classification Search ..... 472/59–65; 463/1, 6, 7, 9; 382/115, 116, 103, 117–120
See application file for complete search history.

(56) References Cited

U.S. PATENT DOCUMENTS 4,688,105 A 8/1987 Bloch et al. ..... 358/335
5,144,454 A 9/1992 Cury ..... 358/335
5,278,662 A 1/1994 Womach et al. ..... 358/335
5,655,053 A 8/1997 Renie ..... 386/117
5,666,215 A * 9/1997 Fredlund et al. ..... 358/487
5,694,514 A 12/1997 Evans et al. ..... 386/46
5,703,995 A 12/1997 Willbanks ..... 386/52
5,740,388 A 4/1998 Hunt ..... 395/328
5,781,885 A 7/1998 Inoue et al. ..... 704/267
5,872,887 A 2/1999 Walker ..... 286/117
6,072,537 A 6/2000 Gurner et al. ..... 348/586
6,220,171 B1 4/2001 Hettema et al. ..... 104/53
6,425,825 B1 7/2002 Sitrick ..... 463/31
6,526,158 B1 2/2003 Goldberg ..... 382/115
6,591,068 B1 7/2003 Dietz ..... 396/429
6,618,075 B2 9/2003 Tomita ..... 348/157

* cited by examiner

*Primary Examiner*—Kien Nguyen
(74) *Attorney, Agent, or Firm*—Allen, Dyer, Doppelt, Milbrath & Gilchrist, P.A.

(57) ABSTRACT

A video recording system for an amusement park ride includes a video camera for generating video images of riders on the amusement park ride, and a video capture device connected to the video camera for capturing the video images. A video server is connected to the video capture device for storing the captured video images. A video disc burner is connected to the video server for burning the stored captured video images of the riders on the amusement park ride onto a video disc.

37 Claims, 3 Drawing Sheets

VIDEO RECORDING SYSTEM FOR AN AMUSEMENT PARK RIDE AND ASSOCIATED METHODS

RELATED APPLICATION

This application claims the benefit of U.S. Provisional Application Ser. No. 60/722,908 filed Sep. 30, 2005, the entire contents of which are incorporated herein by reference.

FIELD OF THE INVENTION

The present invention relates to the field of video recording, and more particularly, to a video recording system for an amusement park ride that creates a video recording of a rider's experience on the ride.

BACKGROUND OF THE INVENTION

Amusement park rides, and specifically roller coasters, are very popular at amusement parks around the world. To capture a rider's experience on a roller coaster, for example, some amusement parks use a camera to photograph each rider at the moment of maximum excitement. The photographs are then displayed to the riders on monitors as they exit the ride. This is done to entice the riders to purchase the photographs as a keepsake.

This method of taking pictures is popular with the riders, but has a number of practical limitations. For example, each rider usually only has the option to purchase one photograph of themselves on the ride. If the ride carries a large number of riders, then several photographs must be taken so that each rider has at least one photograph available for viewing and purchase. The photographs must be grouped together and tracked for each ride so that they can be displayed for viewing. Selectively displaying multiple photographs after each ride, and generating individual packages for the riders based on their selected photograph is inefficient and processing intensive.

An example camera system providing photographs of riders on an amusement park ride is disclosed in U.S. Pat. No. 6,618,075. A moving object detecting sensor and a speed sensor measure the running speed of a roller coaster, for example, and shot timing for operating the camera is decided based on the outputs of the detecting sensor and speed sensor. Since the shot timing is decided considering the speed of the roller coaster, the center of the camera angle can be prevented from deviating from a predetermined shooting position. While the '075 patent addresses the issue of centering the camera angle on an amusement park ride, such as a roller coaster, it does not address the above noted problems of tracking multiple photographs of each ride for individual viewing and purchase.

Amusement park riders also have the option of using a video camera for recording images of their ride. With the use of a video camera, dynamic or full motion situations can be recorded. However, the rider must operate the video camera and as a result, is not in the video. In addition, video cameras typically have limitations and will not work in some situations, such as low-light environments. Moreover, some images on a ride are too difficult or dangerous to capture, either because cameras are not allowed or it is not possible to film the desired image from the optimum location. An example is an image of a rider during a loop on a roller coaster taken from the center of the loop.

SUMMARY OF THE INVENTION

In view of the foregoing background, it is therefore an object of the present invention to efficiently capture and track each rider's experience on an amusement park ride for viewing and purchase.

This and other objects, advantages and features in accordance with the present invention are provided by a video recording system for an amusement park ride comprising at least one video camera for generating video images of riders on the amusement park ride, at least one video capture device connected to the at least one video camera for capturing the video images of the riders on the amusement park ride, and a video server connected to the at least one video capture device for storing the captured video images of riders on the amusement park ride. At least one video disc burner may be connected to the video server for burning the stored captured video images of the riders on the amusement park ride onto a video disc.

The video recording system advantageously records video images of all of the riders on the amusement park ride. The amusement park ride may comprise a roller coaster, for example. Only one set of recorded video images for each completed travel of the roller coaster is tracked for display and purchase by anyone of the riders on that particular ride. The throughput of the video recording system is high since the same recorded images may be repeatedly burned based on the number of riders purchasing a video disc.

The video recording system may further comprise at least one sensor for activating the at least one video capture device based upon proximity of the amusement park ride to the at least one sensor. The at least one sensor may generate an activation signal based upon proximity of the amusement park ride to the at least one sensor. The video recording system may further comprise a controller connected between the at least one sensor and the at least one video capture device. The controller may receive the activation signal for activating the at least one video capture device.

The video recording system may further comprise at least one video monitor connected to the video server for displaying the captured video images. At least one video monitor device may be connected between the video server and the at least one video monitor. The at least one video monitor device receives the captured video images from the video server and provides the captured video images to the at least one monitor for display.

The video recording system may further comprise at least one kiosk for instructing the video server to provide the stored captured video images to the at least one video disc burner. The video recording system may further comprise an Internet connection for connecting to the Internet so that the video recording system can be remotely accessed.

The at least one video disc burner comprises a plurality of video disc burners for simultaneously burning a plurality of video discs. At least two of the video discs being simultaneously burned may correspond to stored captured video images of different riders on different rides of the amusement park ride.

As an alternative to burning the stored captured video images on a video disc, the video server may download the stored captured video images to other types of portable memory devices. For instance, the portable memory device may comprise a memory stick or tape, for example.

Another aspect of the present invention is directed to a method for recording video images of riders on an amusement park ride comprising generating video images of riders on the amusement park ride using at least one video camera, capturing the video images of the riders on the amusement park ride using at least one video capture device connected to the at least one video camera, and storing the captured video images of the riders on the amusement park ride on a video server connected to the at least one video capture device.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
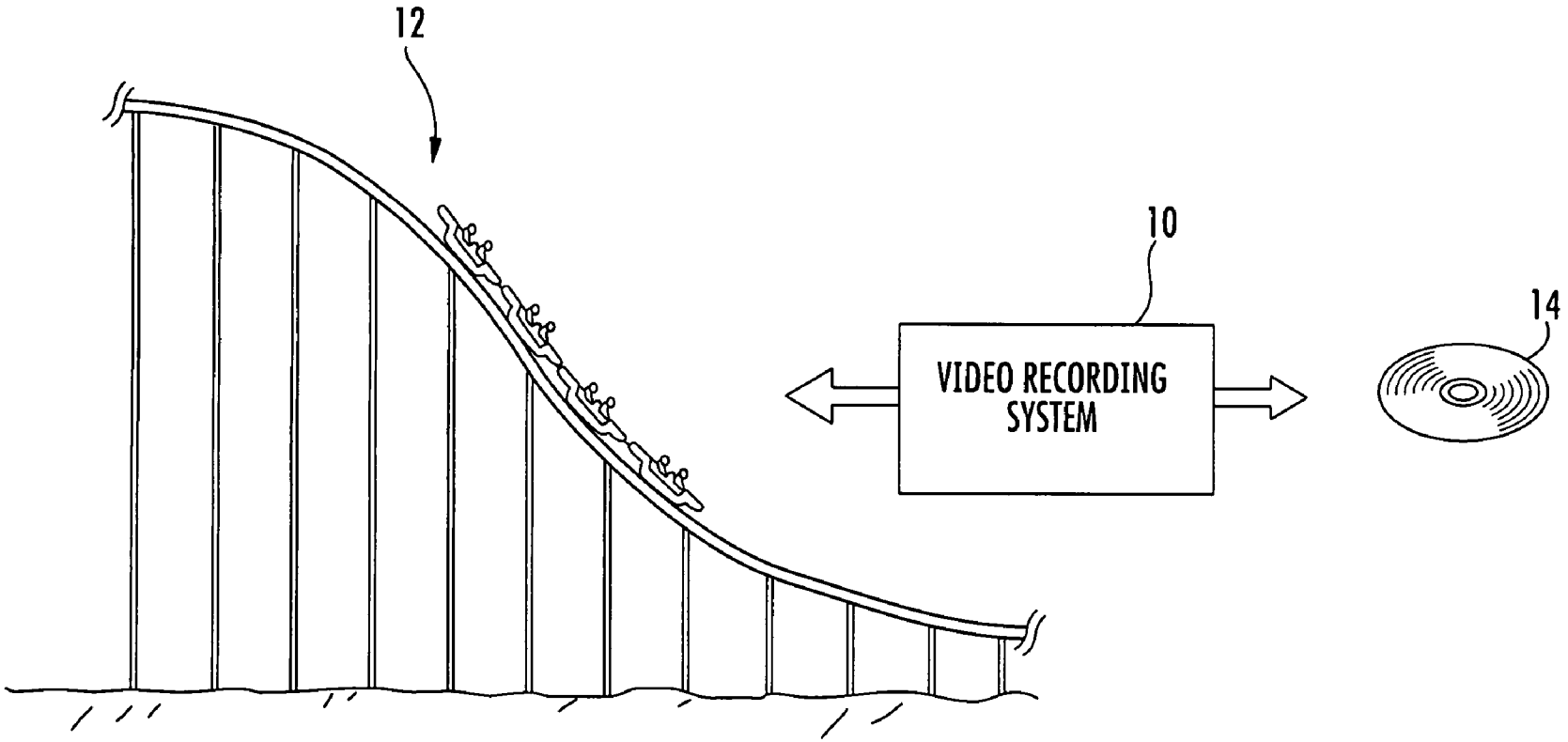
FIG. 1 is a simplified block diagram of a video recording system for an amusement park ride in which a video disc is generated for capturing each rider's experience on the ride in accordance with the present invention.

Referring initially to FIG. 1, a video recording system 10 captures and tracks each rider's experience on an amusement park ride 12. The video recording system 10 creates a video disc 14 in DVD format. The video disc 14 is available for purchase by each rider immediately upon completion of their ride. For purposes of discussing the video recording system 10, the illustrated amusement park ride 12 is a roller coaster. The video recording system 10 can be used with other types of amusement park rides, particularly those that move along a track or predetermined path, including water rides, for example.

The video recording system 10 advantageously records video images of all of the riders on the roller coaster 12. Since still photographs are not used, multiple photographs of each roller coaster ride do not have to be grouped together and tracked for individual display and purchase. Instead, only one set of recorded video images for each completed travel of the roller coaster 12 is tracked for display and purchase by anyone of the riders on that particular ride. The throughput of the video recording system 10 is high since the same recorded images for each completed travel of the roller coaster 12 are repeatedly burned based on the number of riders purchasing a video disc 14.

Figure 2:
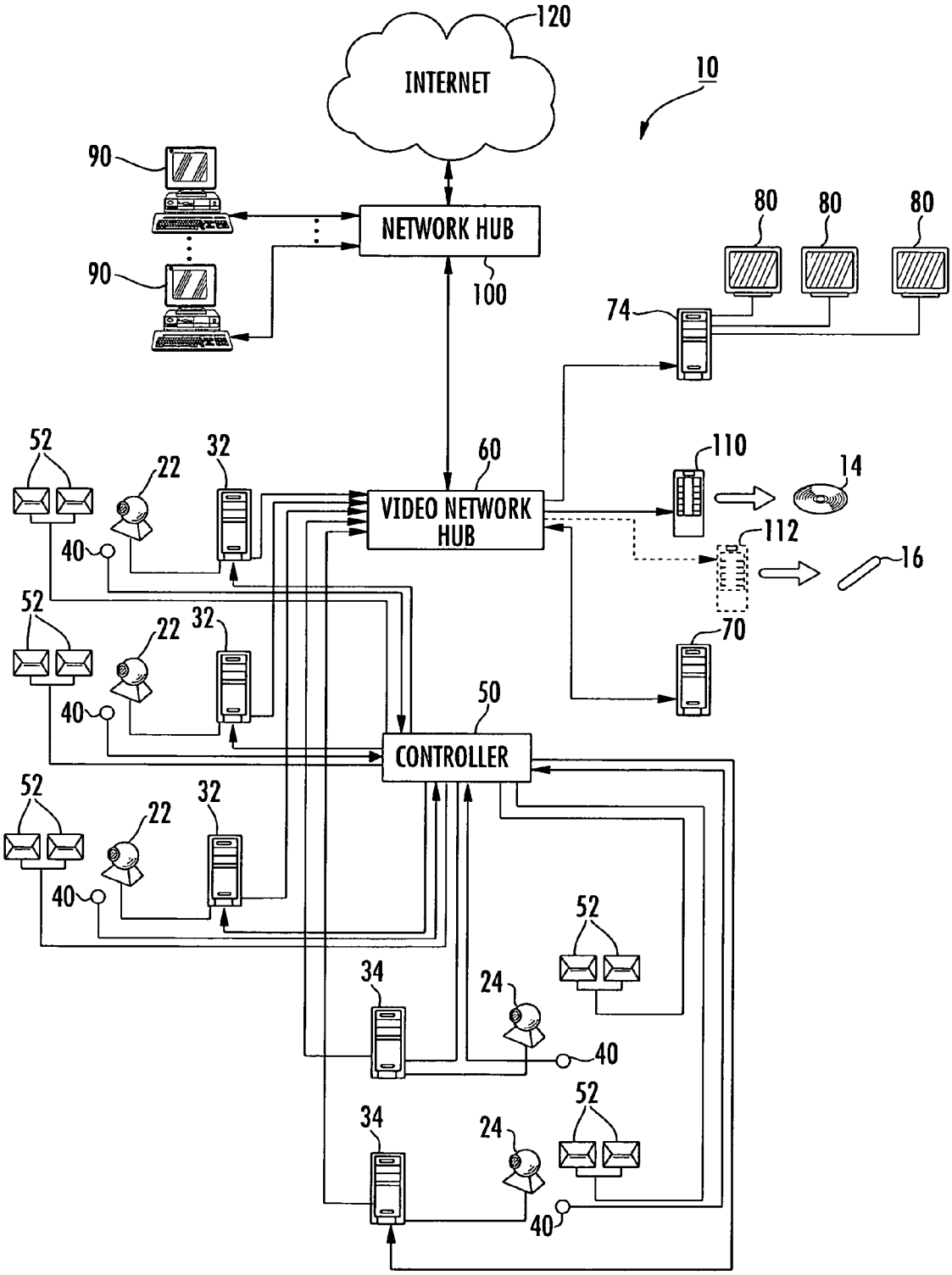
FIG. 2 is a detailed block diagram of the video recording system shown in FIG. 1.

The video recording system 10 will now be discussed in greater detail with reference to FIG. 2. Video cameras 22, 24 are placed in selected locations along the roller coaster 12 for recording video images of the riders as the roller coaster passes by each video camera. The video cameras 22, 24 remain stationary. The video cameras include high speed video cameras 22 and normal speed video cameras 24. The video cameras 22, 24 are preferably digital video cameras.

The high speed video cameras 22 record approximately 200 frames/second, and the normal speed video cameras record approximately 30 frames per second, for example. The high speed video cameras 22 allow the captured images to be converted to slow motion so that when a rider sees the video disc, they will be able to easily recognize themselves and anyone else on the roller coaster 12. The slow-motion feature of the video recording system 10 advantageously allows each person to identify themselves on a high speed amusement park ride, such as a roller coaster 12 that typically reaches speeds exceeding 50 miles per hour. For example, 1 second of recorded video images from a high speed camera 22 may be played back over a period of 6 seconds.

Each video camera 22, 24 is connected to a respective video capture device 32, 34 that runs a capture program for recording specific portions of the roller coaster 12 as it passes by. Video capture devices 32 connected to the high speed video cameras 22 use a high speed capturing program, whereas video capture devices 34 connected to the normal speed video cameras 24 use a normal speed capturing program.

Each video capture device 32, 34 is operated to execute the capture program in response to a sensor 40 detecting the roller coaster. Each video sensor 40 generates an activation signal based on proximity of the amusement park ride 12 to the sensor. The sensors 40 may be optical beam sensors or magnetically activated sensors, as readily appreciated by those skilled in the art.

The sensors 40 are connected to a controller 50 that starts and stops the recording of the roller coaster 12 by each video capture device 32, 34 as the roller coaster approaches and exits the recording view of the respective video cameras 22, 24. The activation signal received by the controller may be a pulse signal, for example. An advantage of a pulse signal is that the controller 50 can more easily filter out false trips. For example, the controller 50 may ignore the first two pulses from each sensor 40 but considers the third pulse to be a valid pulse for activating the video capture devices 32, 34. In addition, depending on the speed of the roller coaster 12, the controller 50 addresses special timing considerations associated with such a high speed ride, as readily appreciated by those skilled in the art.

To insure proper lighting for the video cameras 22 and 24, one or more lights 52 may be used for each video camera. Each respective light 52 is activated by the controller 50 in response to the controller receiving the activation signal from the sensor 40 associated with that particular light. For poor lighting conditions, multiple lights 52 may be used at the same time. If only one light 52 is needed at a time, the additional lights may also be used as backup lights in case the primary light burns out.

The video capture devices 32, 34 also interface with a video network hub 60 for transferring the captured video images to a video server 70. The video server 70 runs a video merge program and is central to the video recording system 10. The video merge program monitors all of the video capture devices 32, 34 for the captured video images. The captured video images are also known as clips.

Once all the captured video images for a particular ride are received by the video server 70, then a script file is generated. Each script file is used to build a video disc 14. The captured video may also be played back and reviewed by an operator to determine if any unacceptable behavior has been displayed by any of the riders. If the operator encounters any such behavior, the operator edits out the offensive images of the rider by masking over or eliminating the offensive behavior through specialized software, as readily appreciated by those skilled in the art.

In addition to the script file being associated with each video disc 14, stock footage of the roller coaster ride 12 is also added. In addition to the stock footage, commercials and advertisements may also be added to each video disc 14.

After each rider exits the roller coaster ride, they are able to view the generated script file on one or more video monitors 80. The stock footage is not shown on the monitors 80. A video multi-monitor device 74 runs a presentation program that looks for each new script file stored on the video server 70. As new script files are generated for subsequent roller coaster rides, the corresponding video images are displayed on the monitors 80. The monitors 80 are placed at various positions near the exit of the roller coaster 12. If a rider is interested in purchasing a video disc 14, they proceed to a kiosk 90.

One or more kiosks or self help units 90 are available for a rider to purchase a video disc of their experience on the roller coaster 12. Each kiosk 90 uses a program that guides the rider from an initial viewing of their video disc 14 to purchase. Each kiosk 90 may be self-help or may be operated by an amusement park employee.

Video of when the rider was on the roller coaster 12 can be retrieved using an identifying number assigned to the script file. This number is given to the riders as they exit the roller coaster 12. Alternatively, if the rider later returns to purchase a video disc 14 but does not remember the identifying number, the rider enters an approximate timeframe of when the roller coaster 12 was ridden, and searches the video recorded during that timeframe.

The kiosks 90 are connected to a network hub 100, which in turn is connected to the video network hub 60. When a request to purchase a video disc 14 of a specific roller coaster ride is received by the video server 70, then the complete video of that ride is received by a video disc burn device 110 for burning the final video onto a compact disc 14 in DVD format. As noted above, the final video includes the script files and stock footage, as well as any commercials 14 and advertisements that may have been added. The video disc burn device 110 is also connected to the video network hub 60. The video disc burn device 110 is capable of simultaneously burning multiple video discs 14. Once a video disc 14 is burned, it is given to the rider.

An advantage of the video disc burn device 110 is that multiple video discs 14 of different roller coaster rides can be burned simultaneously. This particular feature of the video recording system 10 provides a high output/throughput of the video discs 14 for viewing and purchase.

Another factor contributing to the high output/throughput is that the same video disc 14 is burned for each rider on their particular ride of the roller coaster 12. In other words, the script file generated for each completed travel of the roller coaster 14 includes all of the riders. As a result of the video images captured by the high speed cameras 22 being played back in normal speed, portions of each video disc 14 are displayed in slow motion so that everyone who was on that particular ride will be able to easily recognize themselves at some point when viewing the video disc 14.

As an alternative to burning the stored captured video images on a video disc 14, the video server 70 downloads the stored captured video images to other types of portable memory devices. For instance, the portable memory device comprises a memory stick, a floppy disk or a tape, for example. In other words, in addition to or in place of the video disc burn device 110, a portable memory device interface 112 is connected to the video server 70 via the video network hub 60 and downloads from the video server the stored captured video images of the riders on the amusement park ride 12 to at least one portable memory device 16. The illustrated portable memory device is a memory stick 16.

The video recording system 10 is also connected to the Internet 120. Connection to the Internet 120 allows the video recording system 10 to be remotely monitored and accessed. In case of a malfunction of any one of the programs being executed by the video capture devices 32 and 34, the video server 70, the video multi-monitor device 74, and the video disc burn device 110, any one of these devices can be rebooted over the Internet 120. In addition, software upgrades can be uploaded over the Internet 120 to the respective devices as needed.

Another advantage of the video recording device 10 being connected to the Internet 120 is that if one of the lights 52 associated with a particular video camera 22, 24 fails (when more than one light is available for each camera), another light may be remotely activated in its place. This light 52 may be a spare backup light already in position. Alternatively, if more than one light 52 is used during capturing of the video images, the other lights may be resequenced to provide sufficient lighting in the absence of the failed light.

Yet another advantage of the Internet 120 interfacing with the video recording system 10 is that a video disc 14 may be purchased by a rider over the Internet after having left the amusement park. The rider logs onto a particular web cite and searches for the recorded video images by entering the identifying number assigned to the script file. If the rider does not remember the identifying number, then the video images can be searched by date and time.

Figure 3:
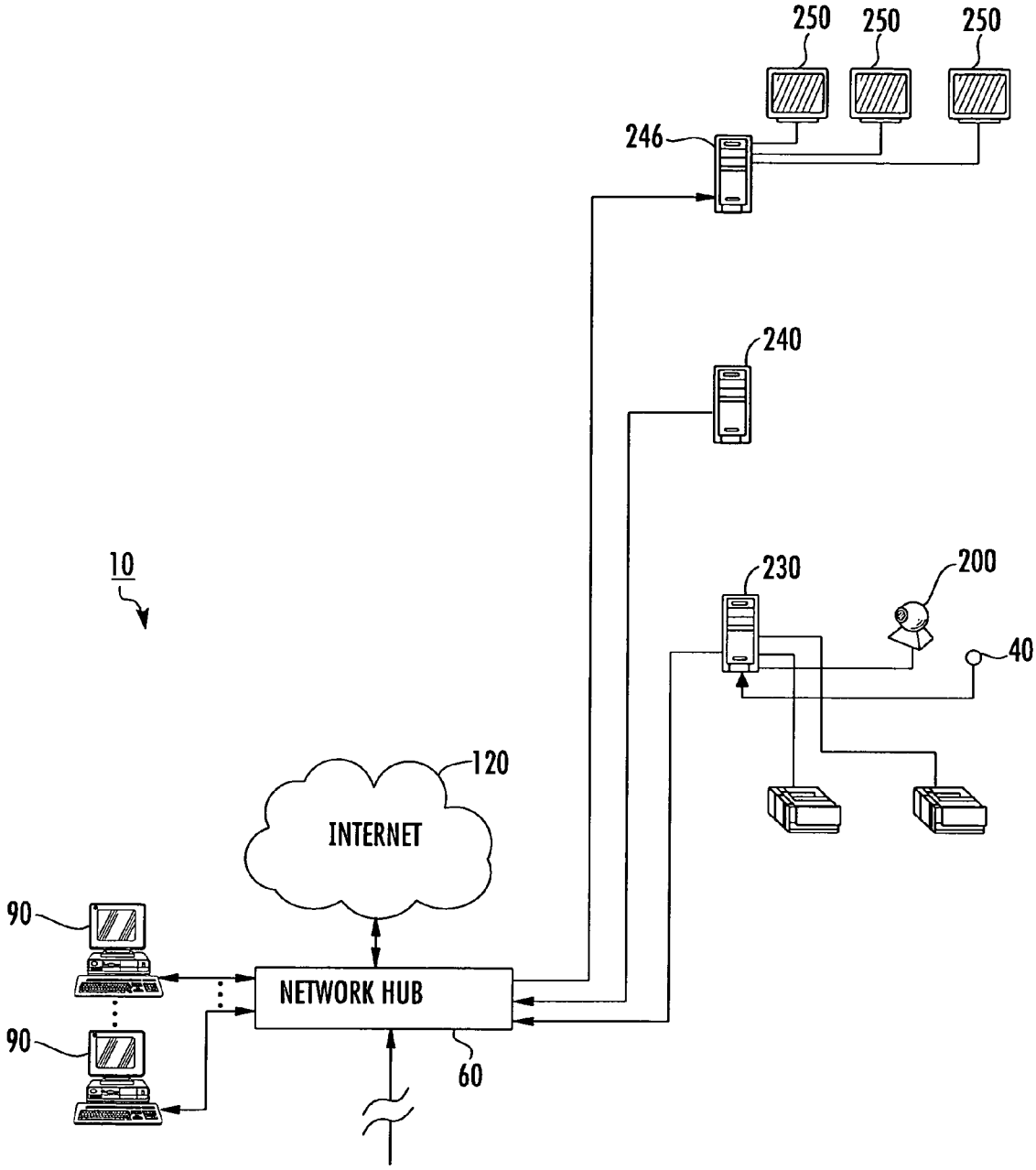
FIG. 3 is a block diagram of a photograph recording system added to the video recording system shown in FIG. 2.

Referring now to FIG. 3, the video recording system 10 may also interface with a photograph recording system. One or more still cameras 200 are positioned along the roller coaster 12 to take still pictures of each rider as they passes by. For purposes of simplifying the illustration, only one still camera 200 is shown when typically more than one still camera would be used for capturing still images of the riders.

Each still camera 200 is also operated in response to a sensor 40 positioned adjacent the track. Pictures from each still camera 200 are captured by a picture capture device 230. Each picture capture device 230 is connected to the network hub 60. A picture server 240 is connected to the network hub 60 for storing the pictures captured by the picture capture device 230.

As with the video images, after each rider exits the ride, they may view the still pictures on one or more display monitors 250. A picture multi-monitor device 246 runs a presentation program that looks for the new picture files on the picture server 240. As the new picture files are generated, the corresponding pictures are displayed on the multiple monitors 250. The monitors 250 are placed at various positions near the exit of the roller coaster 12. If a rider is interested in purchasing a picture, they proceed to one of the kiosks 90.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included as readily appreciated by those skilled in the art.

That which is claimed is:

1. A video recording system for an amusement park ride comprising:

a plurality of sensors generating activation signals, with each sensor generating a respective activation signal based upon proximity of the amusement park ride to that sensor;

a plurality of video cameras for generating video images of riders on the amusement park ride;

a plurality of video capture devices connected to said plurality of video cameras for recording the video images of the riders on the amusement park ride;

a controller connected to said plurality of sensors for receiving the activation signals therefrom, and connected to said plurality of video capture devices for controlling starting and stopping of the recording by each video capture device based on the received activation signal from said sensor associated therewith;

a video server connected to said plurality of video capture devices for storing the recorded video images of the riders on the amusement park ride; and at least one video disc burner connected to said video server for burning the stored recorded video images of the riders on the amusement park ride onto a video disc.

2. A video recording system according to claim 1 wherein each sensor comprises an optical beam sensor.

3. A video recording system according to claim 1 wherein each sensor comprises a magnetically activated sensor.

4. A video recording system according to claim 1 further comprising at least one video monitor connected to said video server for displaying the recorded video images.

5. A video recording system according to claim 4 further comprising at least one video monitor device connected between said video server and said at least one video monitor, said at least one video monitor device receiving the recorded video images from said video server and providing the recorded video images to said at least one monitor for display.

6. A video recording system according to claim 1 further comprising at least one kiosk for instructing said video server to provide the stored recorded video images to said at least one video disc burner.

7. A video recording system according to claim 1 wherein said plurality of video cameras comprise at least one high speed digital video camera so that the video images generated thereby are in high speed; and wherein said video server stores the high speed recorded video images at a lower speed so that during playback the high speed recorded video images are viewed in slow motion.

8. A video recording system according to claim 1 wherein said plurality of video cameras is stationary.

9. A video recording system according to claim 1 further comprising an Internet connection for connecting to the Internet so that the video recording system can be remotely monitored.

10. A video recording system according to claim 9 wherein the video recording system can be reconfigured over the Internet.

11. A video recording system according to claim 1 wherein said at least one video disc burner comprises a plurality of video disc burners for simultaneously burning a plurality of video discs.

12. A video recording system according to claim 11 wherein at least two of the video discs being simultaneously burned correspond to stored recorded video images of different riders on different rides of the amusement park ride.

13. A video recording system according to claim 1 wherein the amusement park ride comprises a roller coaster.

14. A video recording system according to claim 1 further comprising a plurality of lights adjacent said plurality of video cameras and associated with said plurality of sensors, said plurality of lights connected to said controller with each light being activated by said controller in response to the controller receiving the activation signal from said sensor associated therewith.

15. A video recording system according to claim 1 wherein the activation signal comprises a pulse signal.

16. A video recording system for an amusement park ride comprising:

a plurality of sensors generating a plurality of activation signals, with each sensor generating a respective activation signal based upon proximity of the amusement park ride to that sensor;

a plurality of video cameras for generating video images of riders on the amusement park ride;

a plurality of video capture devices connected to said plurality of video cameras for recording the video images of the riders on the amusement park ride, each video capture device associated with a respective sensor;

a controller connected to said plurality of sensors for receiving the activation signals therefrom, and connected to said plurality of video capture devices for controlling starting and stopping of the recording by each video capture device based on the received activation signal from said sensor associated therewith;

a video server connected to said plurality of video capture devices for storing the recorded video images of the riders on the amusement park ride.

17. A video recording system according to claim 16 wherein said video server downloads the stored recorded video images of the riders on the amusement park ride to at least one portable memory device.

18. A video recording system according to claim 17 wherein the at least one portable memory device comprises at least one of a video disc, a memory stick, a tape and a floppy disk.

19. A video recording system according to claim 17 further comprising at least one kiosk for instructing said video server to download the stored recorded video images to said at least one portable memory device.

20. A video recording system according to claim 16 further comprising at least one video monitor connected to said video server for displaying the recorded video images.

21. A video recording system according to claim 20 further comprising at least one video monitor device connected between said video server and said at least one video monitor, said at least one video monitor device receiving the recorded video images from said video server and providing the recorded video images to said at least one monitor for display.

22. A video recording system according to claim 16 wherein said at least one video camera comprises at least one high speed digital video camera so that the video images generated thereby are in high speed; and wherein said video server stores the high speed recorded video images at a lower speed so that during playback the high speed recorded video images are viewed in slow motion.

23. A video recording system according to claim 16 further comprising an Internet connection for connecting to the Internet so that the video recording system can be remotely accessed.

24. A video recording system according to claim 16 wherein the amusement park ride comprises a roller coaster.

25. A video recording system according to claim 16 further comprising a plurality of lights adjacent said plurality of video cameras and associated with said plurality of sensors, said plurality of lights connected to said controller with each light being activated by said controller in response to the controller receiving the activation signal from said sensor associated therewith.

26. A method for recording video images of riders on an amusement park ride comprising:

generating activation signals based upon proximity of the amusement park ride to a plurality of sensors, with each sensor generating a respective activation signal based upon proximity of the amusement park ride to that sensor;

generating video images of the riders on the amusement park ride using a plurality of video cameras;

recording the video images of the riders on the amusement park ride using a plurality of video capture devices connected to the plurality of video cameras;

providing the activation signals to a controller connected to the plurality of sensors, the controller for starting and stopping the recording by each video capture device based on the received activation signal associate therewith; and storing the recorded video images of the riders on the amusement park ride on a video server connected to the plurality of video capture devices.

27. A method according to claim 26 further comprising burning the stored recorded video images of the riders on the amusement park ride onto a video disc using at least one video disc burner connected to the video server.

28. A method according to claim 27 further comprising instructing from at least one kiosk the video server to provide the stored recorded video images to the at least one video disc burner.

29. A method according to claim 27 wherein the at least one video disc burner comprises a plurality of video disc burners for simultaneously burning a plurality of video discs.

30. A method according to claim 29 wherein at least two of the video discs being simultaneously burned correspond to stored recorded video images of different riders on different rides of the amusement park ride.

31. A method according to claim 26 further comprising displaying the recorded video images on at least one video monitor connected to the video server.

32. A method according to claim 31 wherein at least one video monitor device is connected between the video server and the at least one video monitor, the at least one video monitor device receiving the recorded video images from the video server and providing the recorded video images to the at least one monitor for display.

33. A method according to claim 26 wherein the plurality of video cameras comprise at least one high speed digital video camera so that the video images generated thereby are in high speed; and wherein the video server stores the high speed recorded video images at a lower speed so that during playback the high speed recorded video images are viewed in slow motion.

34. A method according to claim 26 further comprising remotely monitoring the plurality of video cameras, the plurality of video capture devices and the video server over the Internet.

35. A method according to claim 26 wherein the amusement park ride comprises a roller coaster.

36. A method according to claim 26 further comprising positioning a plurality of lights adjacent the plurality of video cameras and which is associated with the plurality of sensors, each light being connected to the controller and being activated by the controller in response to the controller receiving the activation signal from the sensor associated therewith.

37. A method according to claim 26 wherein the activation signal comprises a pulse signal.

* * * * *